US007556264B2

(12) United States Patent
Polidoro et al.

(10) Patent No.: US 7,556,264 B2
(45) Date of Patent: Jul. 7, 2009

(54) BANKNOTE CONVEYOR

(75) Inventors: Roberto Polidoro, Cologny (CH); Andre Gerlier, Sciez (FR)

(73) Assignee: MEI, Inc., West Chester, PA (US)

( * ) Notice: Subject to any disclaimer, the term of this patent is extended or adjusted under 35 U.S.C. 154(b) by 219 days.

(21) Appl. No.: 10/539,524

(22) PCT Filed: Dec. 19, 2003

(86) PCT No.: PCT/EP03/14783

§ 371 (c)(1),
(2), (4) Date: Dec. 14, 2005

(87) PCT Pub. No.: WO2004/056684

PCT Pub. Date: Jul. 8, 2004

(65) Prior Publication Data

US 2006/0181014 A1 Aug. 17, 2006

(30) Foreign Application Priority Data

Dec. 23, 2002 (EP) ..... 02258869

(51) Int. Cl.
*B65H 9/16* (2006.01)

(52) U.S. Cl. ..... 271/248; 271/250

(58) Field of Classification Search ..... 271/248, 271/250, 252, 272, 274, 188
See application file for complete search history.

(56) References Cited

U.S. PATENT DOCUMENTS 4,106,767 A * 8/1978 Schirrmeister et al. ..... 271/188
4,971,304 A * 11/1990 Lofthus ..... 271/227
5,078,384 A * 1/1992 Moore ..... 271/228
5,745,540 A 4/1998 Okada et al.
5,769,412 A * 6/1998 Takemoto et al. ..... 271/188
6,338,481 B1 1/2002 Maruchi
6,712,356 B2 * 3/2004 Daout et al. ..... 271/250
2001/0045697 A1 11/2001 Daout et al.
2001/0052667 A1 12/2001 Mochizuki et al.

FOREIGN PATENT DOCUMENTS

| | | | |
|---|---|---|---|
| CN | 1130774 | A | 11/1996 |
| EP | 0 749 926 | A1 | 12/1996 |
| EP | 0 848 357 | A1 | 6/1998 |
| EP | 1 167 260 | A2 | 1/2002 |
| GB | 699071 | | 10/1953 |
| WO | 02/48957 | A1 | 6/2002 |

* cited by examiner

*Primary Examiner*—Kaitlin S Joerger
(74) *Attorney, Agent, or Firm*—Fish & Richardson P.C.

(57) ABSTRACT

A banknote conveyor which includes moveable means for transporting a banknote, the means engaging frictionally with the banknote at at least three points so that the force driving the banknote is dependent on the rigidity of the note. The banknote can further swivel about one of the points to align the note with a desired path. Also provided is a means for limiting the movement of the banknote if the force required to convey the banknote exceeds a predetermined limit and means for preventing the insertion of banknotes or other foreign objects into the conveyor when not in use.

13 Claims, 6 Drawing Sheets

BANKNOTE CONVEYOR

The invention relates to the transport of banknotes or other sheets of value, which are referred to simply as banknotes. The invention will be described in relation to banknote changers which are used in change machines and vending machines to receive, transport, store and dispense banknotes.

Specifically, the invention is concerned with the uptake and alignment of banknotes. The uptake of banknotes involves the initial engagement of the banknote by the mechanism of the changer. Aligning is necessary so that the banknote has the correct orientation when transported to other functional units of the changer such as an acceptor where the banknote is verified. Misalignment of the banknote can cause jamming of the mechanisms in the changer and incorrect verification.

A number of methods and associated apparatus are known in the art for the uptake of banknotes. The most common method is to pinch the note between two rollers and convey the note by rotating the rollers. The banknote is then aligned by being conveyed against a reference surface so that the reaction of the surface against the moving note causes the note to swivel and thereby align with the reference surface.

This method exhibits a number of disadvantages. The force exerted by the rollers on the banknote is constant. Banknotes are variable in quality and a poor quality banknote is less rigid than a better quality banknote. On occasion, a jam in the uptake or alignment mechanism will occur when a poor quality banknote is conveyed against a reference surface causing the banknote to fold instead of swivel, resulting in a misalignment of the note and a subsequent jam. A further disadvantage is that rigid objects such as credit cards may be inserted into the uptake mechanism which may jam the mechanism.

It is however desirable to use as great a force as possible when conveying the banknote to ensure that the banknote is properly aligned.

Another method of banknote uptake involves creating a suction by use of a fan to displace air. The force of the suction is then used to engage the banknote with a driving belt. Although this arrangement lessens the incidents of jamming, banknotes which are crumpled or have lengthwise creases may still cause a jam.

WO-A-02/49945 discloses apparatus for transporting a banknote which includes a curved transport path so that a banknote being transported is bent to increase its rigidity.

U.S. Pat. No. 4,106,767, EP-A-0 749 926 and EP-A-1 167 260 disclose apparatuses for transporting documents wherein the documents are folded to facilitate the transport process.

It is desirable to provide a banknote uptake and alignment mechanism which prevents the insertion of rigid objects and avoids jams caused by poor quality banknotes.

Aspects of the invention are set out in the accompanying claims.

In a further aspect of the invention a banknote conveyor engages a banknote with a force which is dependent on the rigidity of the banknote.

Preferably, the conveyor engages frictionally with and bends the banknote so that the frictional force between the conveyor and the banknote is dependent on the rigidity of the banknote.

The banknote conveyor may engage the banknote at a plurality of points.

The banknote conveyor may further convey the banknote against a first reference surface so that the banknote rotates, moving relative to at least one of the points.

The points are preferably arranged to maximise the distance between a point of rotation and a point of contact of the banknote with the reference surface.

The banknote conveyor may convey the banknote against any one of two reference surfaces and the points may be arranged so that a force due to the conveyor is applied near a middle of the banknote when rotated.

The banknote conveyor may define a banknote path which includes a plurality of contacts which engage with a banknote, at least two of the contacts engaging the banknote on opposite sides of the banknote.

The points of contact may form part of an undulatory surface. In a preferred embodiment, the banknote path is defined by two spaced, complementary surfaces. The surfaces may be spaced by a gap defining a banknote path which may be in the range of 0.1 mm to 3 mm and is preferably 1.5 mm. This distance will depend on, among others, the number of points of contact and the coefficient of friction of the material of the points of contact.

The conveyor may include at least two cams, each engaging the banknote at a point Preferably, a first cam engages the note at two, spaced locations and a second cam engages the banknote at a third point located on an opposite face of the banknote and the cams rotate to convey the banknote.

In yet a further aspect of the invention, the banknote conveyor includes a plurality of corrugated rollers which rotate to convey the banknote.

In yet a further aspect of the invention, a banknote conveyor is provided which includes two opposed complementary surfaces forming an entryway, at least one of which moves to convey a banknote, and which includes means preventing the insertion of an object into the entryway when the at least one surface is stationary.

In yet a further aspect of the invention, a banknote conveyor is provided which includes means for limiting movement of the banknote when a force with which the banknote is conveyed exceeds a predetermined limit. The conveyor may further include means for detecting the force and means for inhibiting movement of the banknote when the detected force exceeds the predetermined limit.

Movement of the banknote may be inhibited by slowing the banknote down, by stopping or reversing the motion of the banknote.

In a preferred embodiment, the banknote conveyor acts as a banknote uptake and the banknote is rejected if the force exceeds the predetermined limit.

Preferably, the means for limiting the movement includes a first gear engageable with a second gear by biasing means so that the predetermined limit is determined by a force required to overcome the biasing force and disengage the first gear from the second gear.

The limiting means may include a first ratchet engaged with a second ratchet.

The limiting means may in addition or alternatively include an electric motor wherein the movement of the banknote is inhibited by limiting a current supplied to the motor.

A further preferred embodiment incorporates a banknote uptake and a banknote aligner, both incorporating aspects of the invention.

In the drawings and accompanying description which follow, like reference numerals are used to denote common features.

Arrangements embodying the invention will now be described by way of example with reference to the accompanying drawings, in which.

Figure 1:
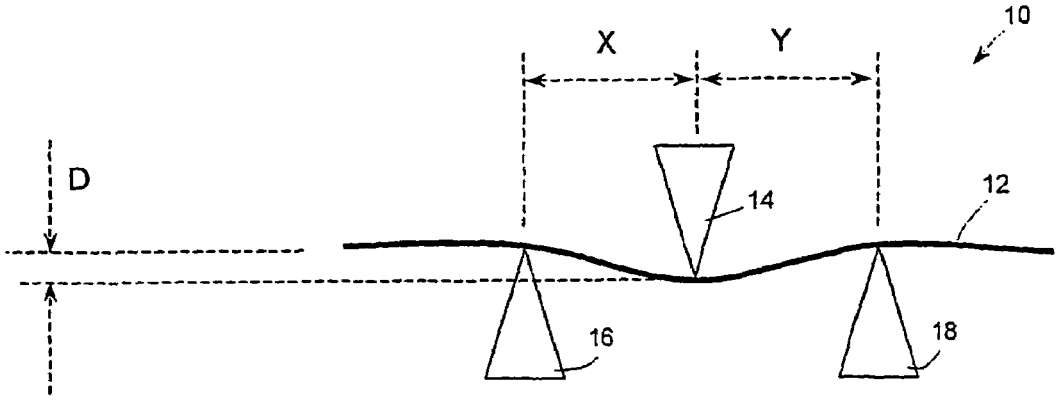
FIG. 1 is a schematic view illustrating the operation of a banknote conveyor according to the invention.

Referring to FIG. 1, a banknote conveyor 10 operates by the frictional engagement of three elements 14, 16 and 18 with a banknote 12. The elements 14, 16 and 18 move to convey the banknote 12 in a desired direction. These elements move in a plane perpendicular to, or in a plane parallel to, the plane of the drawing to convey the banknote. The operation of the invention is not however dependent on the direction of this movement. Both modes of operation are described below with reference to FIGS. 2 and 3.

X is the distance between elements 16 and 14, Y the distance between elements 14 and 18 and D the degree of overlap between element 14 and elements 16 and 18 in the plane defined by the banknote 12 and defines the amount by which the banknote is deformed. The degree of force which is exerted by the elements 14, 16 and 18 on the banknote 12 will depend on the distances X, Y and D and on the rigidity of the note 12. If the distances X, Y and D are maintained as constant, the force will depend only on the rigidity of the note.

Figure 2:
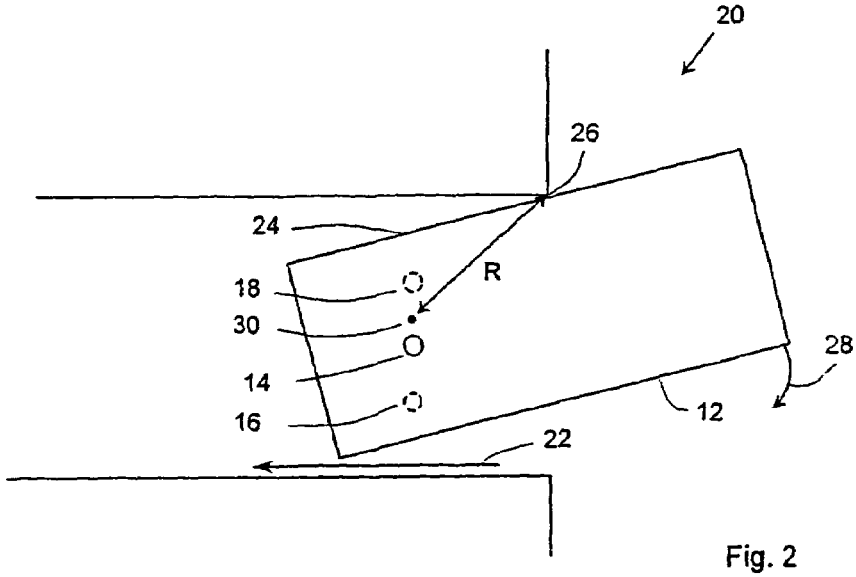
FIG. 2 is a plan view of the apparatus of FIG. 1 arranged to operate in a first mode.

FIG. 2 is a plan view of a bezel 20 incorporating the apparatus of FIG. 1 illustrating a first mode of operation of the apparatus. The elements 14, 16 and 18 move by rotating in a plane perpendicular to the plane of the drawing of FIG. 1 and the banknote 12 is conveyed in the direction of arrow 22. This is part of the process of the uptake of the banknote 12 by the bezel 20. This movement will cause the side 24 of the banknote to come into contact with a reference surface such as a corner 26 of the bezel. As the banknote is conveyed, the reaction of the corner 26 against the banknote 12 will encourage the banknote to swivel in the direction of arrow 28 with a force dependent on a distance R between the corner 26 and a point 30 about which the banknote swivels.

Figure 3:
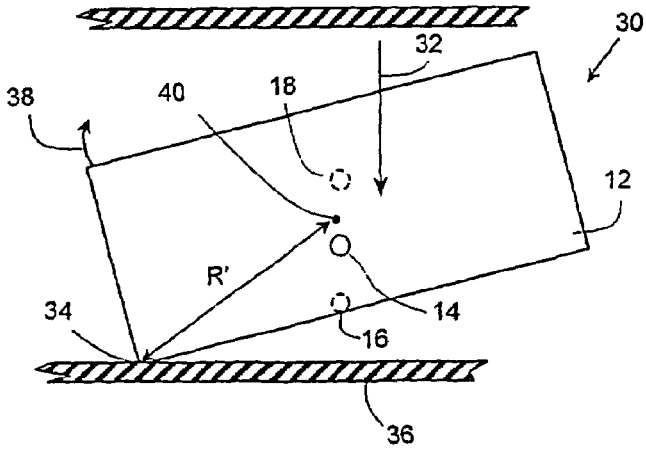
FIG. 3 is a plan view of the apparatus of FIG. 1 arranged to operate in a second mode.

FIG. 3 illustrates the apparatus of FIG. 1 installed in an aligner 30. In this mode of operation, the elements 14, 16 and 18 rotate in a plane parallel to the plane of the drawing of FIG. 1 to move the banknote 12 in the direction of arrow 32. This movement brings a corner 34 of the banknote 12 into engagement with a reference surface 36 causing it to swivel in the direction of arrow 38.

The force which causes banknote 12 to swivel about a point 40 is proportional to the distance R' between corner 34 and the point 40.

As previously described, the elements 14, 16 and 18 engage the banknote with a force which is dependent on the rigidity of the banknote and this allows movement of the banknote relative to any of these points allowing the banknote to swivel. The locations of the points 30 and 40 about which the banknote swivels will vary. These may be located at the point of contact of any one of the elements 14, 16 or 18 with the banknote or may (if the banknote moves relative to all three elements) be located between those points of contact.

It is therefore possible to arrange distances X, Y and D (FIG. 1) as well as the placement of the elements 14, 16 and 18 relative to the corner 26 or the reference surface 36 so that for any banknote the rotational force due to movement against the corner 26 or the reference surface 36 will overcome the force exerted by the elements 14, 16 and 18, causing the banknote to move relative to one or more of those points and rotate. Thus, undesirable folding or bending of the banknote may be prevented.

For a given arrangement such as that illustrated in FIGS. 1 and 2, a less rigid banknote will undergo less force when coming into contact with the corner 26 or the reference surface 36 than a more rigid banknote would. A less rigid banknote will therefore be less susceptible to undesirable folding or bending than it would be in an arrangement which conveyed all banknotes with an unvarying force.

For each arrangement it is possible that more than one reference surface (or corner) is provided against which the banknote reacts to cause rotation. Furthermore, to encourage this rotation the direction of movement of the banknote may be inclined relative to a given reference surface.

Although FIGS. 1, 2 and 3 illustrate three elements 14, 16 and 18 which engage with the banknote 12, the principles described above are equally applicable to banknote conveyors which include a greater number of points of contact with a banknote.

FIGS. 4 to 10 illustrate various embodiments incorporating the principles set out above.

Figure 4:
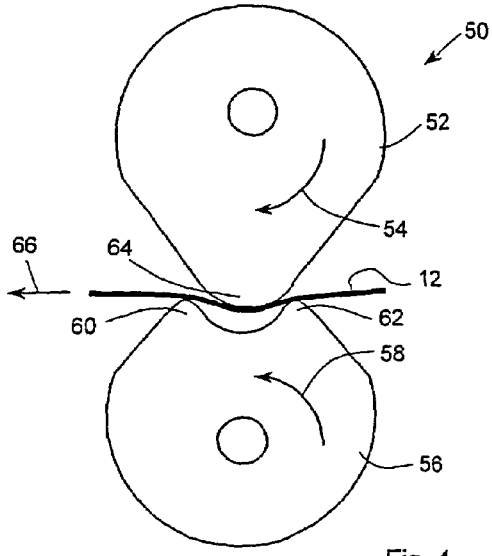
FIG. 4 is a schematic view of a banknote conveyor according to an embodiment of the invention.

FIG. 4 illustrates a banknote conveyor 50. A first cam 52 rotates in the direction of arrow 54 and a second cam 56 rotates in the direction of arrow 58. Cam 56 is formed with an eccentric portion which includes two nodes 60 and 62 which complement a node 64 of the eccentric portion of cam 52. The nodes 60, 62 and 64 deform the banknote in the manner described in relation to FIG. 1 and correspond to the elements 14, 16 and 18 of FIG. 1. With reference to the schematic illustration of FIG. 1, the nodes 60, 62 and 64 move in a direction parallel to the plane of the drawing.

As the cams 52 and 56 rotate in the directions indicated, the banknote 12 is conveyed in the direction of arrow 66 with a force dependent on the rigidity of the banknote.

Figure 5:
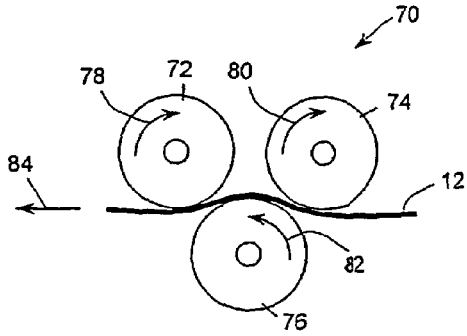
FIG. 5 is a schematic view of a banknote conveyor according to a further embodiment of the invention.

FIG. 5 illustrates a further banknote conveyor 70 where three rollers 72, 74 and 76 engage frictionally with the banknote 12. As the rollers 72, 74 and 76 rotate in the direction of respective arrows 78, 80 and 82, the banknote 12 is conveyed in the direction of arrow 84 with a force dependent on the rigidity. In this embodiment, the rollers 72, 74 and 76 correspond to the elements 14, 16 and 18 of FIG. 1.

Figure 6:
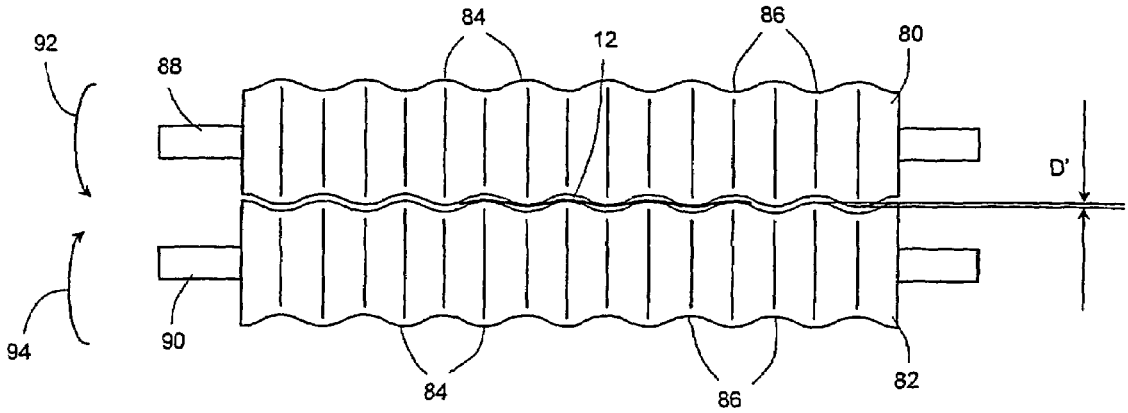
FIG. 6 is a schematic view of a banknote conveyor according to yet a further embodiment of the invention.

FIG. 6 illustrates a further embodiment of the invention. Two uptake rollers 80 and 82 are formed with raised portions 84 and indented portions 86 to form corrugations. The uptake rollers 80 and 82 are arranged so that the respective raised portions 84 of one roller complement the indented portions 86 of the other roller. Provided that a degree of overlap between the respective raised and lowered portions of the uptake rollers 80 and 82 is provided, the banknote 12 is frictionally engaged by the raised and indented portions in the manner described in relation to FIG. 1. The raised 84 and indented 86 portions of the rollers correspond to the elements 14, 16 and 18 of FIG. 1.

Rollers 80 and 82 define a gap D' through which the banknote 12 is conveyed. By varying the size of the gap D', the force with which the rollers engage the banknote is varied.

The size of the gap in the embodiment illustrated is 0.2 mm but it is to be realised that a number of other factors such as the coefficients of friction of the rollers 80 and 82 will also influence the force with which the banknote is conveyed. The size of the gap D' may therefore be altered to compensate for such other factors.

The uptake rollers 80 and 82 rotate about respective axes 88 and 90 in the direction of respective arrows 92 and 94. As the uptake rollers 80 and 82 rotate, the banknote is frictionally engaged by the complementary raised and indented portions of the rollers and thereby conveyed.

Although there are more than three points of contact with the banknote 12, the force with which the banknote is conveyed is nonetheless dependent on the rigidity of the banknote.

Figure 7:
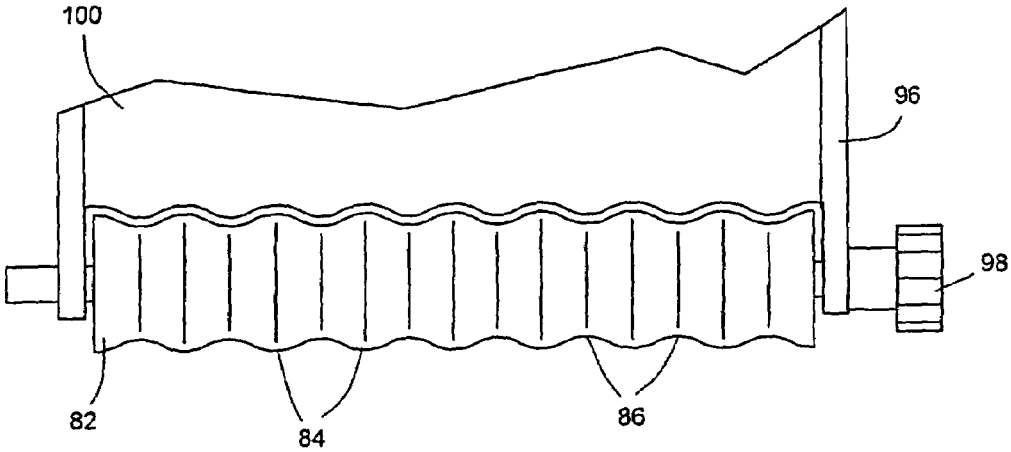
FIG. 7 is a top view of the conveyor of FIG. 6 which has been installed in a support.

FIG. 7 is a plan view of the mechanism of FIG. 5 and illustrates the uptake roller 82 installed in a support 96 with respect to which the uptake roller 82 rotates. The roller is rotated by action on the cog 98. The support 96 includes a plate 100 which is formed to complement the raised portions 84 and the indented portions 86 of uptake roller 82 so that a minimal space exists between the plate 100 and the uptake roller 82. This prevents a banknote becoming frictionally engaged with the uptake roller 82 and being wrapped around the roller as opposed to being transported to the desired location. The same geometry is used for the roller 80.

The uptake mechanism illustrated in FIGS. 6 and 7 has the advantage that the undulate banknote path defined by the gap between the uptake rollers 80 and 82 prevents rigid objects such as credit cards from being inserted into the mechanism. The uptake rollers 80 and 82 may also be brought into contact with one another to provide a seal. This is useful during a cleaning process, particularly when a high pressure water jet is used.

Figure 8:
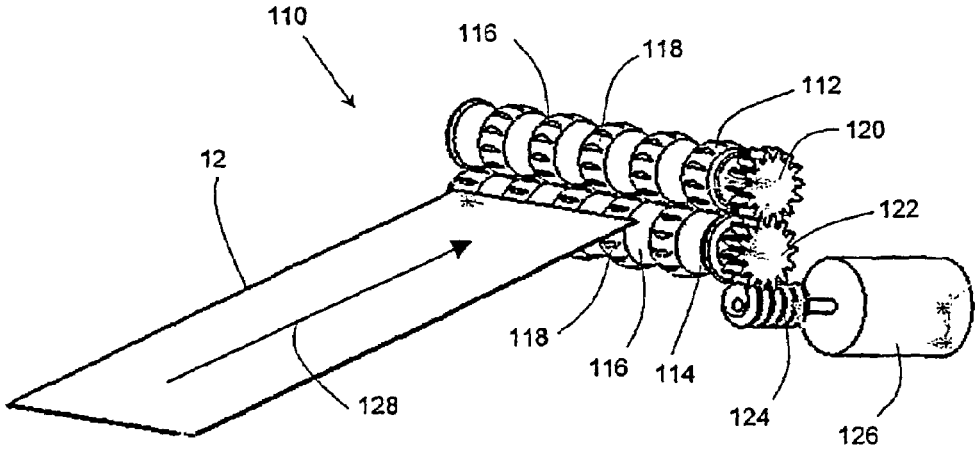
FIG. 8 is a schematic view of a banknote conveyor according to a further preferred embodiment.

FIG. 8 depicts a banknote conveyor 110 which includes rollers 112 and 114. Each roller 112 and 114 has indented 116 and raised 118 portions so that the raised portions 118 of the one roller complement the indented portions 116 of the other roller. Attached to each roller are corresponding cogs 120 and 122 which engage with one another. A worm gear 124, driven by motor 126, engages with cog 122.

The motor 126, when activated, causes the worm gear 124 to rotate, in turn causing the cogs 122 and 124 to rotate. This rotates the rollers 112 and 114. When the rollers 112 and 114 rotate, a banknote 12 may be inserted into the conveyor in the direction of arrow 128 which is then taken up by the rollers and conveyed in the direction denoted by arrow 128.

The motor 126 includes a brake so that the worm gear 124 does not rotate if the motor 126 is not operational. Therefore, a banknote can only be inserted when the motor is activated. This prevents the undesirable insertion of banknotes or other objects when the conveyor 110 is not operational.

The conveyor 110 is intended to be installed in a vending machine or other such device where the uptake and/or conveying of banknotes occurs. By preventing the undesirable insertion of banknotes, access by a user to the machine can be controlled and may, for example, be limited to times when the vending machine is monitored or to prevent a user from attempting to insert a note before being prompted to do so by the vending machine.

Figure 9:
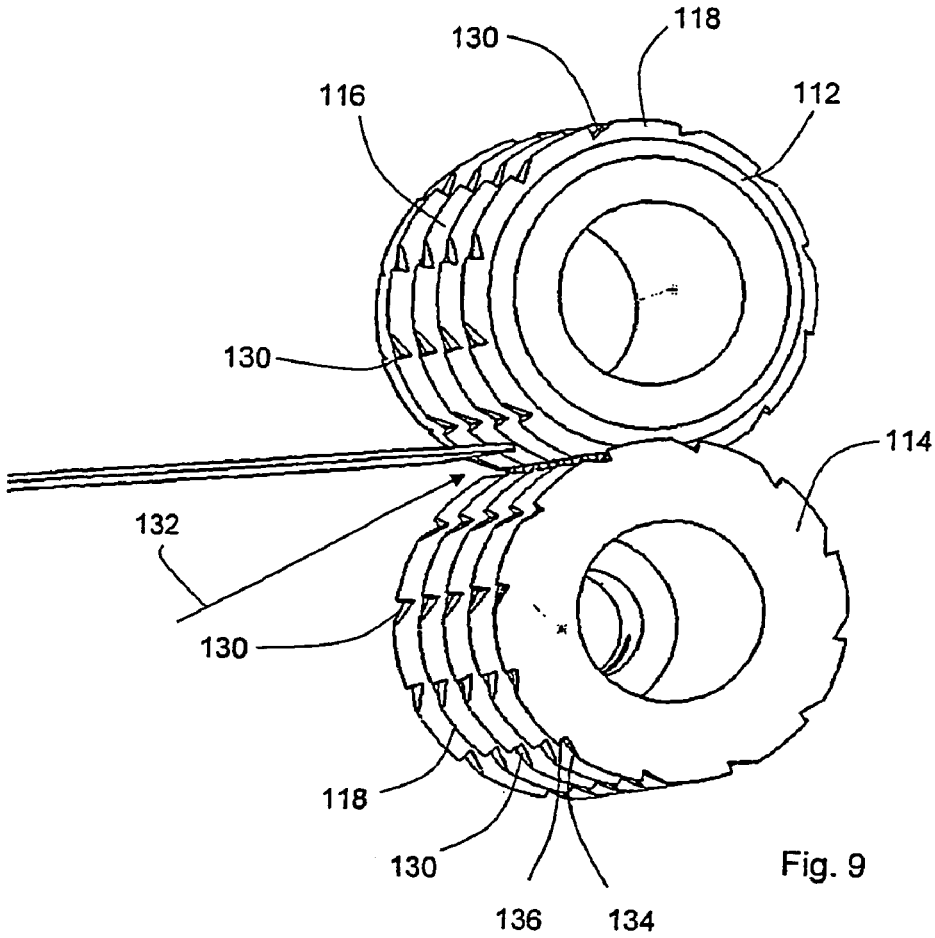
FIG. 9 is a further schematic view of the banknote conveyor of FIG. 8.

FIG. 9 is a further view of the conveyor 110 of FIG. 8 depicting the rollers 112 and 114 with respective raised 118 and indented 116 portions. The raised portions 118 have notches 130 formed in them. When a banknote 12 is inserted into the conveyor 110 in the direction of arrow 132 and the rollers 112 and 114 are not rotating (when the motor is not activated), the notches 130 act to prevent the banknote 12 from being inserted.

As illustrated, the notches have an asymmetrical profile defined by a lead-in surface 134 and a bar surface 136. The lead-in surface 134 acts to divert the path of the banknote so that, when inserted, it is brought into contact with the bar surface 136. The bar surface 136 is orientated substantially perpendicular to the lead-in surface and each notch of one of the rollers co-operates with the raised portions 118 of the other of the rollers so that further motion of the banknote in the direction of arrow 132 is prevented once the leading edge of the banknote comes into contact with the bar surface 136. The notches 130 also act to prevent the insertion of other objects into the conveyor 110 such as credit cards. The notches may be provided with a symmetrical profile too.

Figure 10:
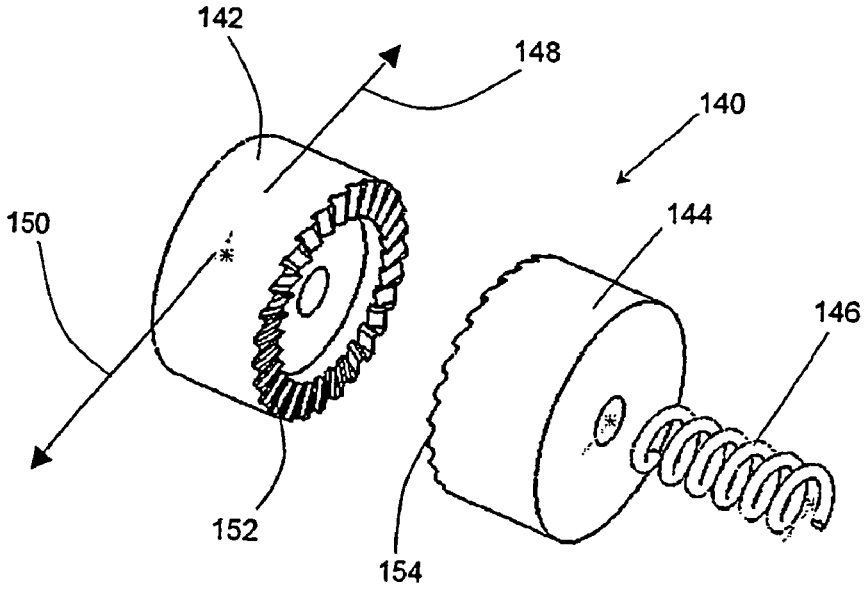
FIG. 10 is a schematic view of a torque limiter for use with a banknote conveyor.

FIG. 10 depicts a one-way torque limiter 140 which is used in conjunction with the conveyors herein described or with any other conveyor, and is particularly useful where a document such as a banknote is conveyed with a force proportional to the rigidity of the banknote. Ratchets 142 and 144 engage with one another and spring 146 acts against a surface (not shown) and ratchet 144 so that ratchets 142 and 144 engage with one another with a predetermined force.

As illustrated in FIG. 10, the ratchets 142 and 144 have respective complementary surfaces 152 and 154 each of which is asymmetrically formed so that rotation of one of the ratchets relative to the other is easier in the direction of arrow 148 than in the direction of arrow 150.

In use, ratchet 144 is connected to roller 114, for example, and ratchet 142 is driven by a motor (not shown) so that a banknote engaged with the rollers 114 and 112 is driven in the direction of arrow 148. The torque limiter 140 acts as a clutch, and as the force with which spring 146 brings ratchets 142 and 144 into engagement is predetermined, ratchet 142 will move with ratchet 144 if the force applied in direction of arrow 150 is less than a predetermined limit. Should this force exceed this limit, the biasing force of the spring 146 will be overcome, causing ratchet 142 to move relative to ratchet 144, thereby inhibiting the movement of the banknote.

The torque limiter acts together with a banknote conveyor where the banknote is conveyed with a force which is dependent on its rigidity. Therefore, the biasing strength of the spring 146 can be chosen so that the conveyor will only act to convey banknotes having less than a predetermined rigidity. This prevents the unwanted insertion of incorrect banknotes and unwanted objects such as credit cards.

It is to be realised that the torque limiter described above may be advantageously used with the conveyor 110 described above with reference to FIGS. 8 and 9; the notches 130 of the rollers 112 and 114 acting to prevent the insertion of undesirable objects when the conveyor is not operational and the torque limiter 140 having the same function during operation of the conveyor.

A detector may be used to determine when the force required to convey the banknote exceeds the predetermined limit. Once this limit is reached, the motor driving ratchet 142 can be stopped or reversed. If reversed, ratchet 142 will again engage with ratchet 144 and the banknote will move in the opposite direction to arrow 150 and be expelled from the conveyor.

The torque limiter described above is one manner in which the movement of a banknote conveyor may be limited in relation to the force needed to convey a banknote. The force needed to convey the banknote may be detected by known force detectors. The current to a motor driving rollers 112 and 114 (or any other known conveyors) can then be limited or reversed in dependence on the detected force.

Figure 11:
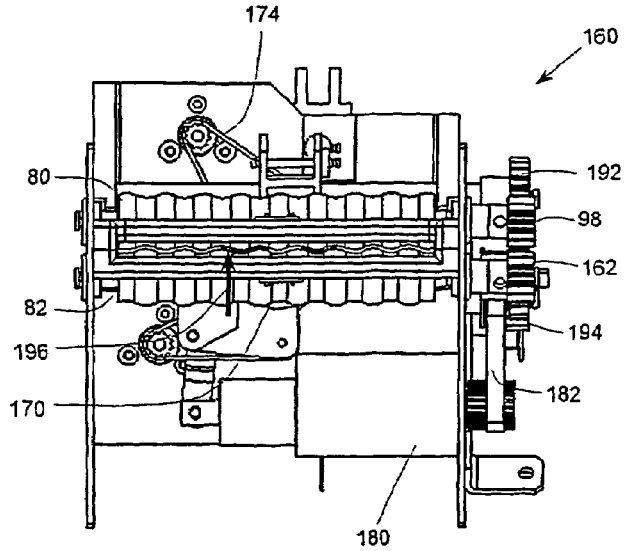
FIG. 11 is an end view of a banknote uptake and alignment device according to the invention incorporating the mechanism of FIG. 6.
Figure 12:
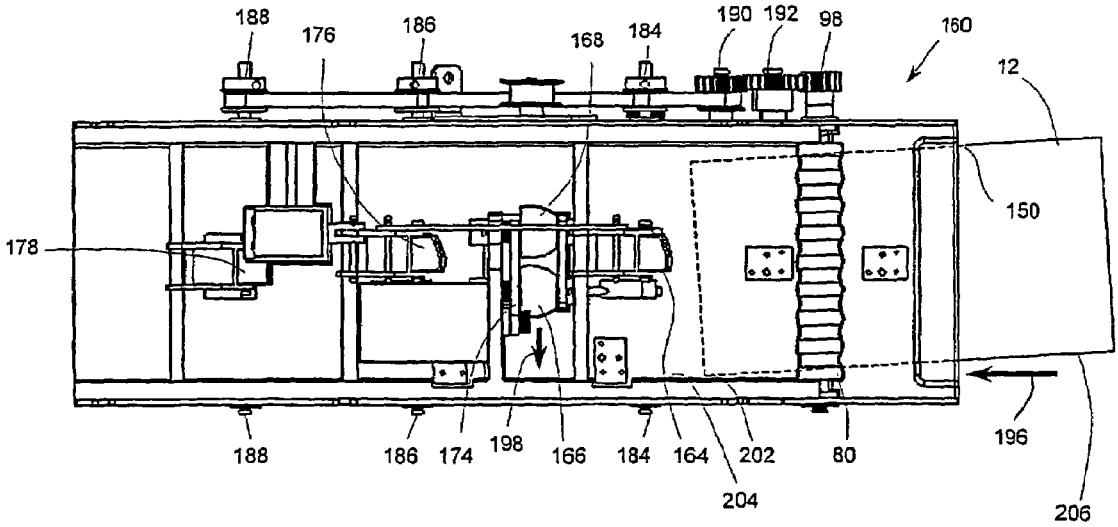
FIG. 12 is a top view of the device of FIG. 8.
Figure 13:
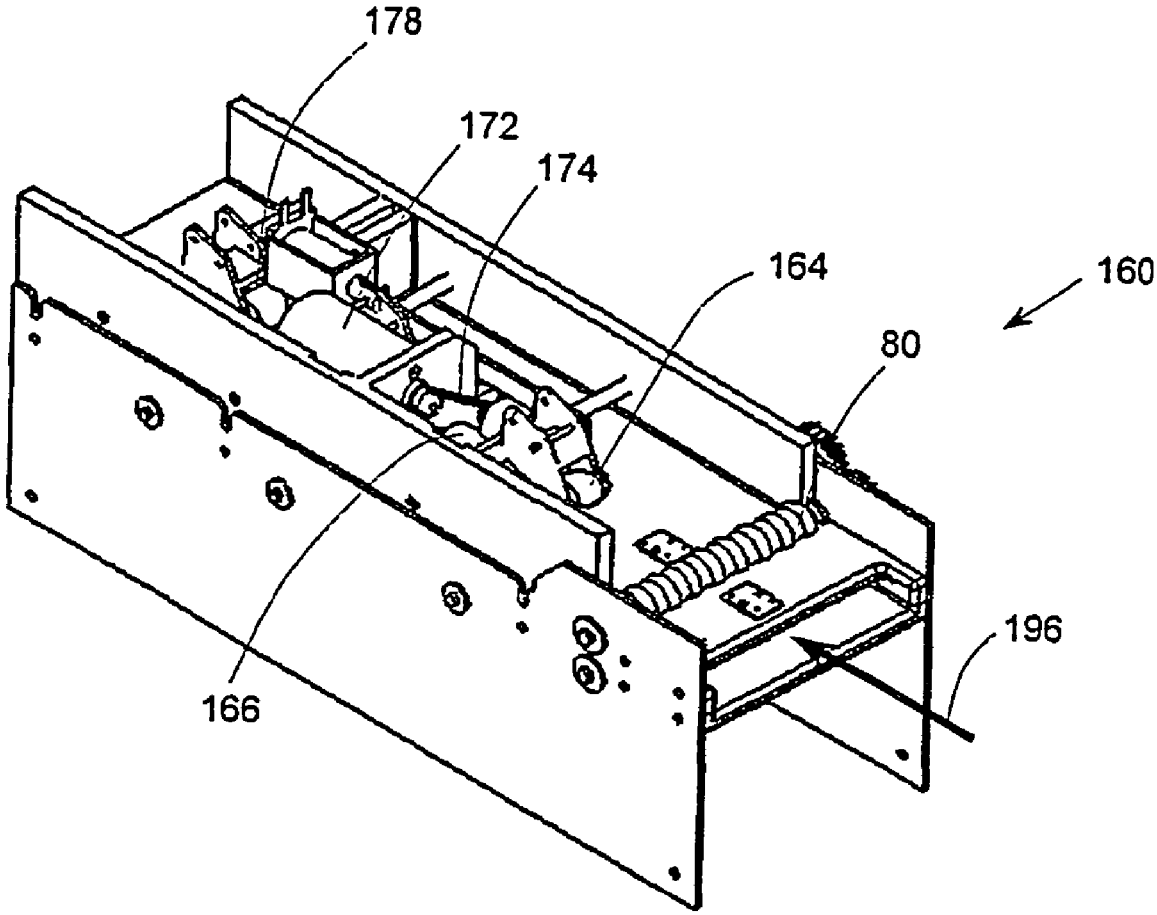
FIG. 13 is an isometric view of the device of FIG. 8.

With reference to FIGS. 11, 12 and 13 a banknote uptake and alignment device 160 includes engaging uptake rollers 80 and 82, defining a banknote entryway, together with a bezel (not shown) having respective cogs 98 and 162 which engage with one another so that the uptake rollers 80 and 82 are driven at the same rate. Although the depicted uptake and alignment device has rollers 80 and 82 of the form described in relation to FIGS. 6 and 7, rollers 112 and 114 described in relation to FIGS. 8 and 9 may also advantageously be utilised with the illustrated device 160.

The device 160 further includes a gripping roller 164 and three aligning rollers 166, 168 and 170. Roller 170 is orientated below and in between the rollers 166 and 168 in the configuration shown in FIG. 5. A motor 172 drives the aligning rollers 166, 168 and 170 by means of a belt 174. The device 160 also includes two additional gripping rollers 176 and 178.

A second motor 180 drives a belt 182 which, by means of axes 184, 186 and 188 drives respective rollers 164, 176 and 178. The belt 182 also drives a cog 190 which, in turn, is engaged with a cog 192 which drives the cog 98 of uptake roller 80. Similarly, cog 190 also drives a cog 194 which is engaged with the cog 162 of uptake roller 82 which is driven thereby. The motor 180 therefore controls the movement of the uptake rollers 80 and 82 as well as the gripping rollers 164, 176 and 178.

The operation of the device 160 will now be described. A banknote 12 (FIG. 12) is inserted in the direction of arrow 196. A sensor (not shown) senses that the banknote has been inserted and activates the motor 180 which causes the uptake rollers 80 and 82 to rotate. The uptake rollers engage frictionally with the banknote and cause it to be conveyed further in the direction of arrow 196 with a force which is dependent on the rigidity of the banknote due to the deformation of the note caused by the complementary surfaces of the rollers 80 and 82. The points of contact of the rollers 80 and 82 with the banknote also facilitate slippage of the note relative to the rollers. Therefore when the banknote 12 is inserted so that its path causes a collision with a corner 200 of the device 90, the reaction of the corner 200 on the banknote 12 swivels the banknote thereby correcting its path. This prevents possible folding of the note which could result in the banknote becoming jammed or not being correctly verified. This corresponds to the mode of operation described above with reference to FIG. 2.

Once the banknote has cleared the uptake rollers 80 and 82 and the longitudinal middle of the banknote has reached the location of the aligning elements 166, 168 and 170, the motor 180 is stopped and the motor 172 is activated, driving the alignment rollers 166, 168 and 170 and conveying the banknote in the direction of arrow 198. This will cause the corner 202 of the banknote 12 to engage with the reference surface 204 and the banknote to swivel around this corner until its side 206 is aligned against the reference surface 204. This corresponds to the mode of operation described above with reference to FIG. 3.

The rollers 164 and 176 are dropped and convey the banknote so that the roller 114 engages with it. The roller 164 conveys the banknote 12 from the uptake to the alignment rollers and rollers 176 and 178 convey the banknote 12 further. The device 160 is generally installed in a banknote changer (not shown) which is installed in a vending machine (not shown). The banknote is further transported to a banknote store or to other functional areas of the vending machine.

In a further embodiment, the torque limiter 110 described with reference to FIG. 10 may be utilised in the device 160 connected to either of the rollers 80 or 82 or, in a further embodiment, the rollers 112 or 114 of FIGS. 8 and 9 used in place of the rollers 80 and 82.

Furthermore, the torque limiter 110 may be used in conjunction with any of the conveying arrangements herein described where the force with which a banknote is conveyed is proportional to the rigidity of the banknote.

The invention claimed is:

1. A method of conveying a banknote comprising:

frictionally engaging at least three points with the banknote so as to partially deform the banknote, two of the points engaging opposite faces of the banknote; and moving at least one of the points in a direction of intended movement of the banknote so that, at least during conveyance of the banknote, the points have a fixed relative spacing for any given position of the points and for any given banknote and wherein the at least one point moves to convey the banknote against a reference surface orientated substantially in parallel with said intended direction of movement of the banknote so that the banknote rotates to align the banknote.

2. A method according to claim 1 wherein the points are arranged in a line.

3. A method according to claim 1 including moving the banknote relative to at least one point while moving the at least one point.

4. A method according to claim 1 including inhibiting movement of the banknote if a force required to move the banknote exceeds a predetermined limit.

5. A banknote conveyor comprising:

at least two surfaces arranged to frictionally engage opposite sides of a banknote so as to deform the banknote and to move so as to transport the banknote along a direction of intended movement, said surfaces being arranged so that, at least during transport of the banknote, the surfaces have a fixed relative spacing for any given position of the surfaces and for any given banknote, said conveyor further including a reference surface oriented substantially in parallel with said direction of intended movement, wherein in the event of the banknote being conveyed against the reference surface, the banknote rotates so as to be aligned with the direction of intended movement.

6. A banknote conveyor according to claim 5 wherein said surfaces define at least three points of engagement with the banknote.

7. A banknote conveyor according to claim 6 wherein the banknote moves relative to at least one point while being conveyed.

8. A banknote conveyor according to claim 5 which includes a first and a second corrugated roller.

9. A banknote conveyor according to claim 8 wherein the first and the second rollers are engageable to create a seal.

10. A banknote conveyor according to claim 5 which includes a first and a second cam.

11. A banknote conveyor according to claim 5 which includes three rollers.

12. A banknote conveyor according to claim 5 comprising means for limiting movement of the conveyor if a force required to move the banknote exceeds a predetermined limit.

13. A banknote conveyor for conveying a banknote along a direction of intended movement, the banknote conveyor being arranged to engage a banknote by means of surfaces which define a gap of predetermined configuration which is wider than the thickness of the banknote and of non-linear configuration so as to cause bending of the banknote when viewed in the direction of transport so that the force by which the banknote is gripped is dependent upon the rigidity of the banknote and which acts to align the banknote by conveying the banknote against a reference surface orientated substantially in parallel with said intended direction of travel of the banknote so that the banknote rotates.

* * * * *